US006101679A

United States Patent [19]

Freund et al.

[11] Patent Number: 6,101,679

[45] Date of Patent: Aug. 15, 2000

[54] DISTRIBUTION OF FIBER FROM PNEUMATIC FIBER CONVEYING SYSTEM

[75] Inventors: Kenneth Stephen Freund, Gallatin; Todd Arden McCoy, Hendersonville, both of Tenn.

[73] Assignee: E. I. du Pont de Nemours and Company, Wilmington, Del.

[21] Appl. No.: 09/163,679

[22] Filed: Sep. 30, 1998

[51] Int. Cl.[7] ..... D01B 1/00

[52] U.S. Cl. ..... 19/97.5; 19/205

[58] Field of Search ..... 19/97.5, 200, 204, 19/205, 105; 209/146, 147, 906, 915; 406/62, 63, 65, 66, 67, 100, 102, 103, 104, 69, 70, 82, 155, 168, 170, 171, 172, 175, 181

[56] References Cited

U.S. PATENT DOCUMENTS

| | | | |
|---|---|---|---|
| 1,850,937 | 3/1932 | Messinger | 406/181 |
| 1,871,853 | 8/1932 | Kennedy | 406/181 |
| 1,913,676 | 6/1933 | Kerr | 406/100 |
| 2,208,788 | 7/1940 | Courtney | 406/155 |
| 4,030,280 | 6/1977 | Folk et al. | 57/58.95 |
| 4,175,893 | 11/1979 | Vollrath et al. | 406/52 |
| 5,044,046 | 9/1991 | Pinto et al. | 19/205 |
| 5,226,213 | 7/1993 | Lewis et al. | 19/66 |
| 5,606,776 | 3/1997 | Freund et al. | 19/105 |

FOREIGN PATENT DOCUMENTS

| | | | |
|---|---|---|---|
| 0 737 762 | 10/1996 | European Pat. Off. | D01G 23/02 |
| 641669 | 2/1937 | Germany | 76/36 |
| 27 20 340 | 11/1979 | Germany | D01G 23/08 |

*Primary Examiner*—Michael A. Neas
*Assistant Examiner*—Gary L. Welch

[57] ABSTRACT

A device and process for dividing a pneumatic flow of fiber into a plurality of streams of pneumatically-conveyed fiber which aid in distributing the fiber more uniformly across an area such as a fiber bin.

8 Claims, 3 Drawing Sheets

DISTRIBUTION OF FIBER FROM PNEUMATIC FIBER CONVEYING SYSTEM

FIELD OF THE INVENTION

This invention relates to handling bulk textile fiber and more particularly to processes and equipment for handling textile fiber in a pneumatic conveying system.

BACKGROUND OF THE INVENTION

One of the difficulties in handling textile fiber is the tendency for fiber to settle in mounds or piles when it is desirable that the fiber be generally uniformly dispersed. It appears to be a problem regardless of whether the fiber is individualized fiber filaments, in clumps, tufts or in some other form. In the production of spunlaced nonwoven fabrics, more uniform basis weight distribution is obtained when the fiber is more uniformly dispersed across the width of the fabric at the earliest stages of formation. E. I. du Pont de Nemours and Company, Wilmington, Del. (DuPont) has invested considerable time and effort to improve uniformity in the manufacture of its Sontara® spunlaced fabrics. DuPont's focus for providing the desired uniformity has been the chute feeder which creates a batt of fibers for processing into the finished spunlaced fabric. The chute feeder is disclosed in U.S. Pat. No. 5,606,776 to Freund et al. and includes a bin or hopper in which fiber is first provided. The fiber is typically supplied by a pneumatic conveyor and in the conventional arrangement, the fiber enters an inlet in one wall of the bin or hopper. The fiber in the bin or hopper tends to pile into a mound close to the center near the inlet. The batt from the chute feeder tends to have a heavier or denser portion along the center where the fiber was mounded in the hopper. The denser and heavier portion tends to be found throughout the process and even in the final product.

SUMMARY OF THE INVENTION

Accordingly, it is an object of the present invention to overcome the above noted drawbacks of the prior art and more particularly to provide improved fiber distribution of fiber in fiber handling system.

One idea proposed to better distribute the fiber across the width of the bin is to divide the pneumatic conveyor into a plurality of flows of fiber. Each of the flows would be provided to separate inlets in the bin and being evenly separated so that the one central mound would be separated into a series of smaller mounds. The chute feeder would then be able to even out the less dramatic unevenness of the plurality inlet. However, it has been found that the effects of even small scale unevenness can be found in the final product. Moreover, fiber does not naturally distribute itself uniformly across a pneumatic conveying tube thus making separation into a plurality of evenly divided flows quite unlikely.

Thus, it is a further object of the present invention to divide a single flow of pneumatically conveyed fiber into a plurality of generally evenly divided flows of fiber.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily to scale. The drawings are briefly described as follows.

DETAILED DESCRIPTION OF THE INVENTION

Figure 1:
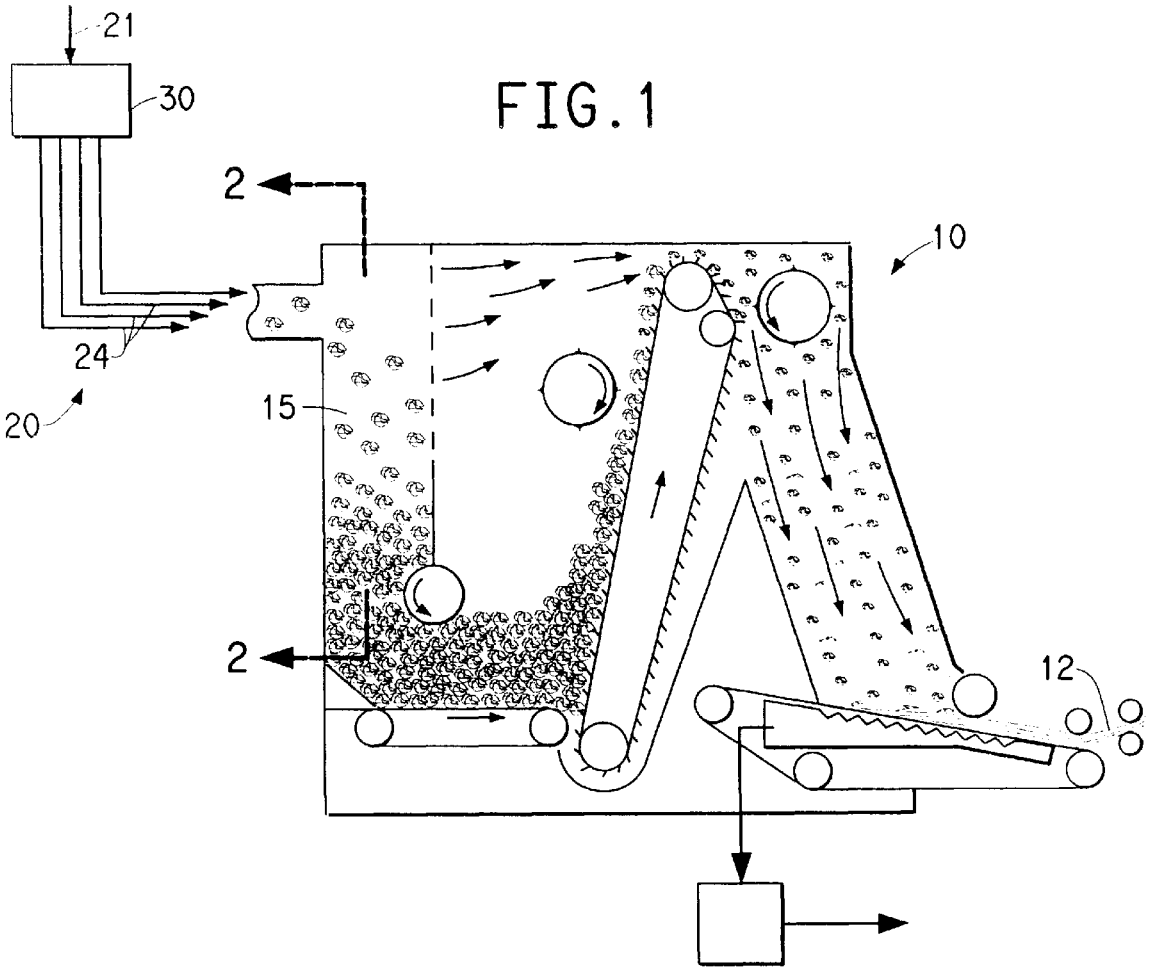
FIG. 1 is a cross sectional side elevational view of a chute feeder with a pneumatic conveying system illustrated schematically providing fiber to the chute feeder.
Figure 2:
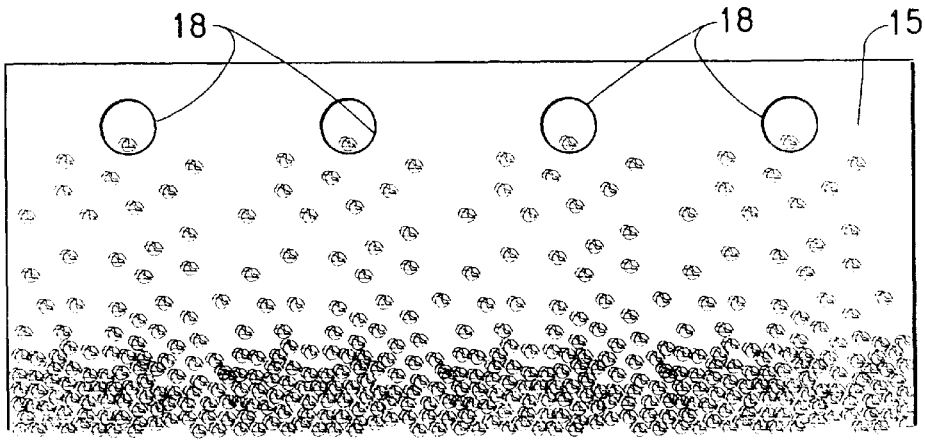
FIG. 2 is a cross sectional view of the chute feeder of FIG. 1 taken along the Line 2—2.

Turning now to the drawings, there is shown in FIG. 1 a chute feeder 10 which receives fiber in the form of fiber tufts from a pneumatic conveying system 20 and forms a batt 12 from the fiber. The chute feeder 10 includes a hopper 15 for receiving the fiber. It is preferred that the fiber be as uniformly distributed across the hopper 15 as possible. Thus, in accordance with the invention as shown in FIG. 2, the hopper 15 includes a plurality of inlets 18 which are evenly spaced across the width thereof. The inlets 18 are fed by a plurality of feed conduits 24 of the pneumatic conveying system 20.

Pneumatic conveying systems are well known and in common usage in the textile industry and the pneumatic conveying system 20 of the present invention is intended to be generally representative of such systems with the addition of a unique element. As with all pneumatic conveying systems, fiber typically in the form of tufts is fed into a moving airstream within a duct or conduit and carried along with the air stream. The pneumatic conveying system 20 comprises a primary conduit 21 into which such fiber is fed and carried by the airstream. However, in the subject invention the pneumatic conveying system 20 includes a distributor 30 which divides the fiber laden airstream into a plurality of fiber laden airstreams which are then carried in the feed conduits 24. The distributor 30 is not just a simple branching of the conduit because it is also intended to evenly divide or distribute the fiber in each of the airstreams in the feed conduits 24. Because the fiber is not generally evenly distributed across the duct of a pneumatic system, evenly dividing the fiber is no simple task. The fiber tends to be carried along primarily at the bottom of the duct or along the outside of any bend. These considerations would need to be incorporated into any means for evenly dividing the fiber.

Figure 3:
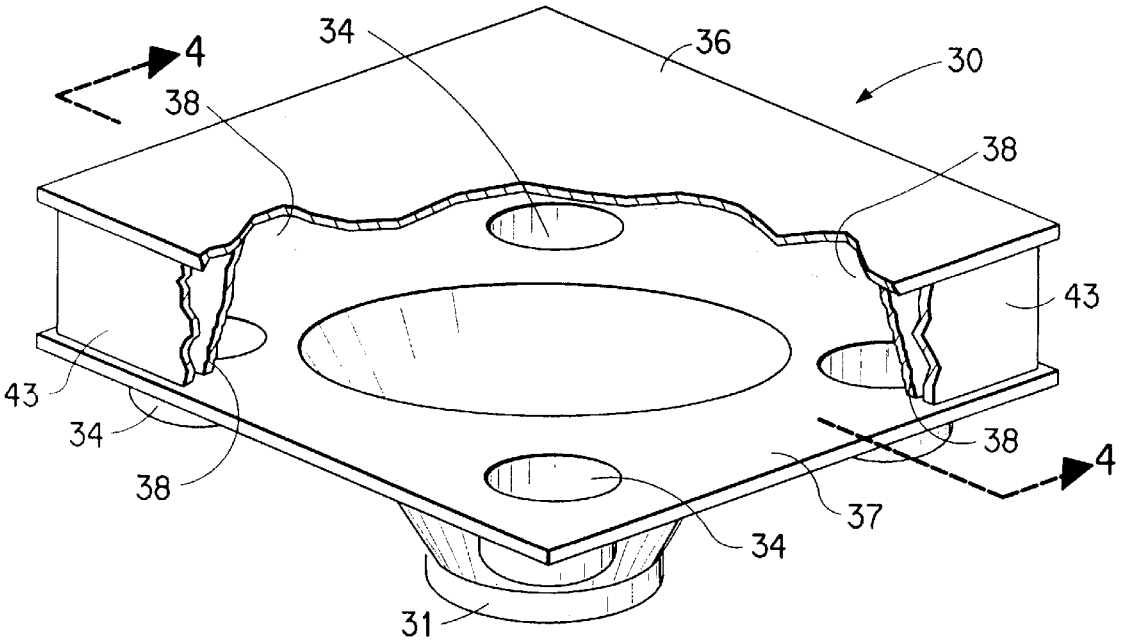
FIG. 3 is a perspective view of a first embodiment of a distributor.
Figure 4:
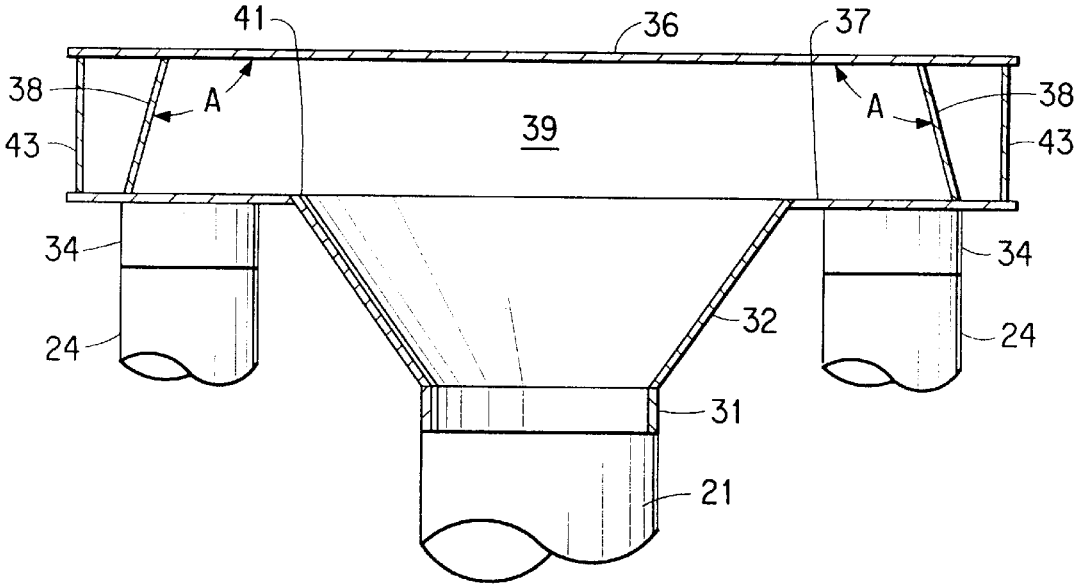
FIG. 4 is a cross sectional view of the distributor of FIG. 3 taken along the Line 4—4.

Turning now to FIGS. 3 and 4, a first embodiment of the distributor 30 is illustrated as having the appearance of a rather flat square box. The box or housing is defined by generally parallel, opposed and spaced apart first and second walls 36 and 37 with deflector walls 38 extending between the first and second walls 36 and 37 at about the periphery thereof enclosing an interior space 39. In the illustrated embodiment, there are shown to be four deflector walls 38 closing the space between the first and second walls 36 and 37. In addition, there are four peripheral walls 43 at the edges of the first and second walls 36 and 37 and just outside of the deflector walls 38 from the interior space 39. The peripheral walls 43 provide structural support for the distributor 30 and may be replaced by other suitable bracing or deleted entirely should the deflector walls 38 provide adequate rigidity and structural integrity. From the drawings, the deflector walls are not arranged at a normal or perpendicular angle to the first or second walls 36 and 37 for reasons which will be discussed below, so in the preferred embodiment, peripheral walls 43 provide structural integrity.

The distributor 30 includes a primary inlet 31 connected to the primary air conduit 21 of the pneumatic conveying system 20 for receiving fiber. The primary inlet 31 is connected to the second wall 37 by a conically diverging portion 32. The conically diverging portion 32 has an inner diameter that substantially increases from the primary inlet 21 to the primary opening 41 which is about twice the diameter of the primary inlet 31. The primary opening 41 is positioned in about the center of the second wall 37 and more preferably, at the center of the interior space 39 between the deflector walls 38. In the illustrated embodiment, there are four outlets 34 arranged adjacent the intersections of the deflector walls 38. The outlets 34 are connected to the feed conduits 24 as shown in FIG. 1 to the chute feeder 10.

As briefly noted above, the distributor 30 divides the fiber laden airstream in the pneumatic conveying system 20 in a way that rather equally divides the fiber into a plurality of separate airstreams. The process of separation is rather simple and may be understood by following the path of the fiber and air in the distributor. Clearly, it is understood that the air will be moving through the distributor 30 by the force of whatever fans or blowers are used within the overall pneumatic conveying system 20 and the to the extent that the separate ports 34 and their associated feed conduits have similar back pressure, the air flow (not considering the fiber) will be generally equally divided. Thus the challenge is to get the air to carry roughly equal amounts of fiber out each port 34.

The fiber and airstream is primarily divided by a blunt impact against the first wall 36. The airstream tends to react to the blunt impact by spreading radially outwardly in the relatively flat distributor 30 towards the deflecting walls 38. The fiber is also spread radially outward by the blunt impact except that it tends to remain close to the first wall 36 as it moves towards the deflector walls 38. The deflector walls 38 are arranged at an angle A to the first wall 36, being slightly greater than perpendicular or 90 degrees thereby directing the fiber away from the first wall 36 and back towards the center of the interior space 39. Preferably the angle A is about 105° but it should be understood that a fairly broad range from near 95° up to about 135° may be suitable.

Bumping the fiber back toward the center of the interior space 39 reduces the opportunity for the fiber to settle out of the airstream by keeping the system flowing. It is also preferred that the ports 34 are positioned at the intersection of the deflector walls 38 thereby being farthest from the primary inlet 31. Although some fiber will surely impact the center of each of the deflector walls 38, the air will naturally move toward the ports 34 picking up fiber with it.

There are of course other considerations that will help optimize the operation of the distributor 30. For example, it is most desirable that the primary conduit have a generally straight run in a vertical direction for the last fifteen or more feet leading to the primary inlet 31 without making any significant turns or bends which would tend to make the fiber favor any one side of the primary inlet 31 as it enters the distributor. For the best results, the primary conduit 21 should make about a fifteen foot vertical run upwards into the bottom of a horizontally arranged distributor 30. By providing that the final run be vertically upward, gravity tends to help distribute fiber in the primary air conduit 21 providing the most even distribution of fiber. It should be noted that at any one instant in time, the fiber may not be evenly distributed since it may be in clumps. However, even over relatively short periods of time, such as several minutes, the amount of fiber going through each of the ports 34 can be fairly even. With the fiber being fairly evenly divided among the various feed conduits 24, then the fiber may be more evenly distributed laterally across the chute feeder 10.

It should be noted that the distributor 30 is amenable to having more or less outlets. For example, the illustrated embodiment (FIG. 3) has the shape of a square box with four outlets. Other designs were tested having six and eight outlets. The six outlet design had the shape of a hexagon and the eight outlet design had the shape of a octagon. Clearly, one can envision a design having a large number of outlets where the deflecting walls start to appear like a continuous circle.

Figure 5:
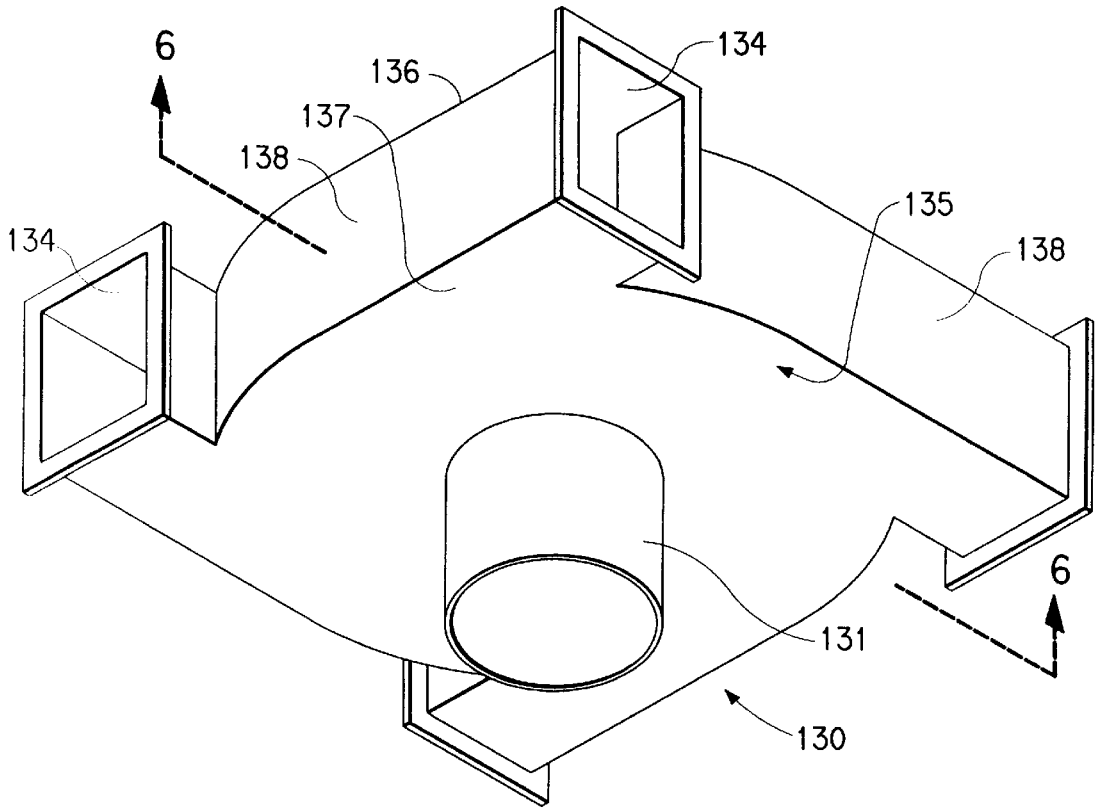
FIG. 5 is a perspective view of a second embodiment of a distributor.
Figure 6:
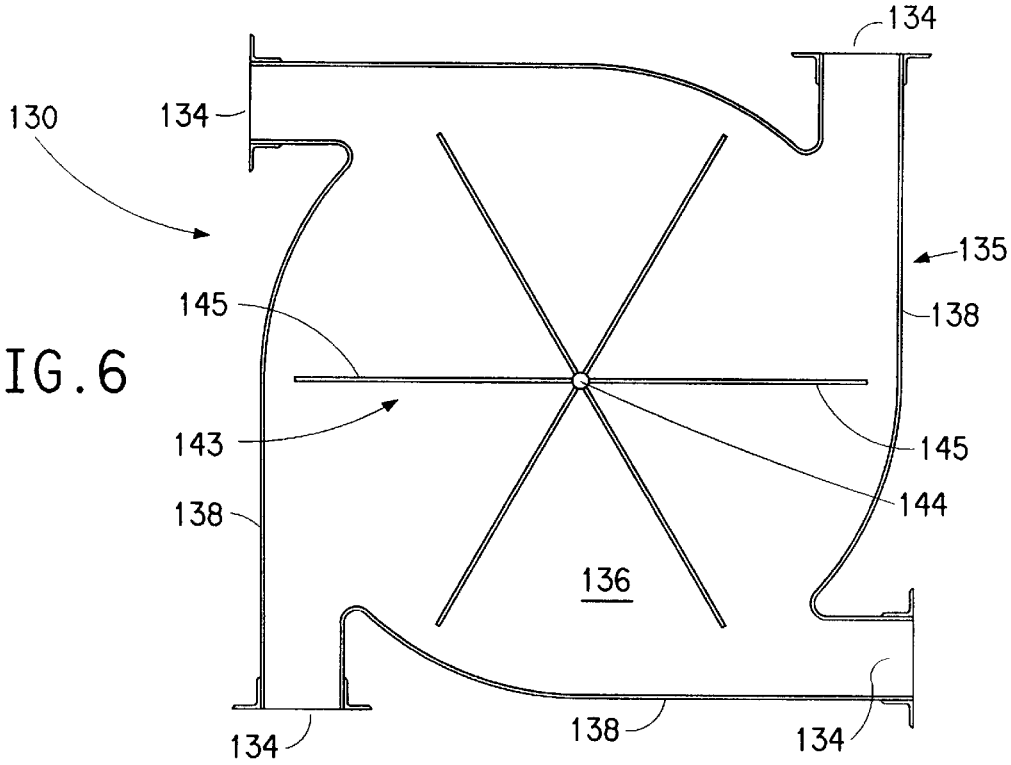
FIG. 6 is a cross sectional view of the distributor of FIG. 5 taken along the Line 6—6.

A second embodiment of the distributor, indicated by the number 130 is illustrated in FIGS. 5 and 6. The distributor 130 has the appearance of a centrifugal fan with a plurality of outlets. The distributor 130 comprises a housing 135 with a paddle fan 143 arranged to rotate about a shaft or hub 144. The hub 144 is driven by a motor (not shown) arranged outside the housing 135 and preferably attached to the outside of the housing 135 by suitable means such as bolts. The paddle fan 143 includes a number of paddle blades 145 which rotate about the hub 144 so as to push air and fiber toward the outlets 134. An inlet 131 is arranged to coincide with the hub 144 of the paddle fan 143 such that the primary air conduit leading to the inlet 131 is generally coaxial with the hub 144. With this arrangement, the air and fiber enter the housing from the primary air conduit 21 along a path generally coaxial with the hub 144 and turns and centrifugally spreads out within the housing 135 moving to one of the outlets 134.

In the second embodiment, there are preferably four outlets 134 although more or less outlets may be suitable. Four outlets were selected as a practical matter since more outlets would have made the design and construction of the housing 135 more complicated. The housing 135 comprises first and second generally parallel, opposed and spaced apart walls 136 and 137 and contoured side walls 138 connecting the first and second walls at about their periphery. The contoured side walls 138 of the housing 135 are arranged radially from the distal ends of the paddle blades 145 and contoured to at least partially follow the circular path of the distal ends of the paddle blades 145. The contoured side walls 138 straighten to form a tangential portion terminating at the outlet 134. As the outlets 134 are generally equally spaced around the periphery of the housing 135, the amount of fiber and air will be substantially evenly divided among the outlets.

One particular advantage of the second embodiment of the distributor 130 is revealed when one of the outlets may become blocked or occluded by fiber which has stopped or settled down in the feed conduit 24. In this second embodiment, the paddle fan 143 continues to push air and fiber into each outlet 134 at the urging of the motor (not shown) such that the pressure in the occluded duct will increase urging the blockage to move along and in most cases abate the blockage. Another feature and advantage of the second embodiment is that it is less sensitive to gravitational effects as the centrifugal forces created by the motor (not shown) and fan blades 145 have more influence on the distribution of fiber in the distributor 130. The second embodiment may provide an additional advantage in that it may eliminate the need for an additional fan for the pneumatic conveying system or reduce the energy requirements of the pneumatic conveying system.

The foregoing description and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown. Clearly, the scope of any patent rights granted on this application should be measured and determined by the claims that follow.

What is claimed is:

1. A fiber distributor for dividing a pneumatic flow of fiber into a plurality of separate, pneumatically-conveyed, fiber-laden airstreams wherein the fiber is substantially evenly distributed in each of the separate airstreams, the fiber distributor comprising:

a housing having at least one inlet for receiving the pneumatic flow of fiber and air and a plurality of outlets through which the separated fiber-laden airstreams exit said housing;

a flow director comprising a relatively flat wall opposite said inlet within the housing causing the flow to move radially outwardly from said path leading into and through said inlet, the flow director arranged to spread the pneumatic flow of fiber and air in a direction generally outwardly from a path leading into and through said inlet; and dividers, comprising a plurality of deflector walls and said deflector walls are arranged to intersect at each outlet and further arranged to separate the spread pneumatic flow into generally equally divided airstreams and direct the airstreams to said outlets.

2. The fiber distributor according to claim 1, wherein said deflector walls are inclined outwardly from said relatively flat wall at an angle of between 95 and 135 degrees.

3. The fiber distributor according to claim 2, wherein said deflector walls are inclined outwardly from said relatively flat wall at an angle of between 100 and 110 degrees.

4. The fiber distributor according to claim 2, wherein said inlet includes a diverging conical portion leading into said housing.

5. The fiber distributor according to claim 4, wherein said conical portion includes an axis which is approximately normal to said relatively flat wall and wherein said axis is at least nearly vertically oriented.

6. The fiber distributor according to claim 5, wherein said conical portion is oriented so that the pneumatic flow of fiber enters nearly vertically upwardly into said housing.

7. A process for dividing a pneumatic flow of fiber into a plurality of separate, pneumatically-conveyed, fiber-laden airstreams, wherein the process comprises:

directing the pneumatic flow of fiber into a housing in a first direction of travel;

spreading the pneumatic flow of fiber generally radially outwardly from the first direction of travel to disperse the fiber and air by impacting the flow bluntly against a surface within the housing causing the flow to move radially from the first direction of travel; and channeling the spread air and fiber within the housing to each of the plurality of outlets by directing the fiber and air by deflector walls to the outlets which are positioned at each intersection of the deflector walls.

8. The process according to claim 7, wherein the step of channeling the spread fiber and air further includes deflecting the fiber away from the blunt impact surface with deflector walls which are arranged at an angle from the blunt impact surface of between 95 and 135 degrees.

* * * * *